US009903695B1

(12) United States Patent
Goodman et al.

(10) Patent No.: US 9,903,695 B1
(45) Date of Patent: Feb. 27, 2018

(54) METHOD AND DEVICE FOR INITIATING AN EXPLOSIVE TRAIN

(75) Inventors: Kenneth Goodman, Richmond, TX (US); Francois Black, Dhahran (SA); Allan Goldberg, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 623 days.

(21) Appl. No.: 13/609,430

(22) Filed: Sep. 11, 2012

Related U.S. Application Data

(60) Provisional application No. 61/595,224, filed on Feb. 6, 2012.

(51) Int. Cl.
*F42C 15/34* (2006.01)

(52) U.S. Cl.
CPC ..... *F42C 15/34* (2013.01)

(58) Field of Classification Search
CPC ..... F42C 15/34
USPC .... 102/222, 221, 262, 226, 201.1, 254, 229, 102/202.2; 89/1.15
See application file for complete search history.

(56) References Cited

U.S. PATENT DOCUMENTS

| | | | | |
|---|---|---|---|---|
| 4,378,740 | A * | 4/1983 | Schneider, Jr. | 102/216 |
| 4,662,279 | A | 5/1987 | Popovitch | |
| 4,727,809 | A * | 3/1988 | Watson | 102/254 |
| 4,982,663 | A | 1/1991 | Scheve et al. | |
| 5,033,382 | A | 7/1991 | Webb | |
| 5,067,405 | A | 11/1991 | Popovitch et al. | |
| 7,347,278 | B2 | 3/2008 | Lerche et al. | |
| 7,505,244 | B2 | 3/2009 | Lerche et al. | |
| 2008/0134922 | A1 | 6/2008 | Grattan et al. | |
| 2010/0005992 | A1 | 1/2010 | Crawford | |

FOREIGN PATENT DOCUMENTS

| | | | |
|---|---|---|---|
| RU | 2380653 | C2 | 1/2010 |
| SU | 5958 | A1 | 7/1928 |
| SU | 9459 | A1 | 5/1929 |

OTHER PUBLICATIONS

Chinese Application No. 201380008160.4, 2nd Office Action, dated Dec. 28, 2015, 13 pgs.
Examination Report issued in related AU application 2013267991 dated May 26, 2016, 3 pages.
Decision of Grant issued in the related RU application No: 2014136351, dated Mar. 17, 2017 (15 pages).
Office action received in the related RU application 2014136351, dated Jan. 17, 2017 (10 pages).

* cited by examiner

*Primary Examiner* — Reginald Tillman, Jr.
(74) *Attorney, Agent, or Firm* — Tuesday Kaasch

(57) ABSTRACT

A detonator device includes a mechanism for shifting between an out-of-line orientation, wherein initiation of a detonator does not result in initiation of the explosive train, and an in-line orientation, wherein initiation of the detonator results in initiation of the explosive train.

10 Claims, 5 Drawing Sheets

METHOD AND DEVICE FOR INITIATING AN EXPLOSIVE TRAIN

CROSS-REFERENCE TO RELATED APPLICATIONS

This application is a non-provisional application claiming the benefit of U.S. Provisional Patent Application No. 61/595,224, filed 6 Feb. 2012, which is hereby incorporated in its entirety herein.

FIELD

The invention relates to an arming apparatus and, more particularly, to a method and device for initiating an explosive train to detonate an explosive, such as with a perforating gun.

BACKGROUND

Many known explosives require significant shock, heat, force or other stimuli to detonate, generally referred to as a secondary explosive. As such, an explosive train is often used to efficiently detonate these explosives, where the explosive train often includes a detonator and an intermediary. To provide ease of use, detonators generally are constructed using easily detonated primary explosives.

Given the ease of ignition of a detonator, precautions are taken to prevent accidental initiation of the detonator or to interrupt the explosive train extending to the explosive.

A first known approach is to physically isolate the detonator from the rest of the explosive train until just before the desired detonation. This requires an operator to physically connect the detonator to the rest of the explosive train at the final location of usage. While advantageous in that the explosive train is not complete prior to connection, the initiation device must be connected before detonation is needed and, in perforating a wellbore, before the explosive is positioned.

Another approach is the use of a deflagration to detonation device, exploding bridgewire or exploding foil initiator to directly detonate an explosive train constructed solely of secondary explosives. While effective, these systems are limited by the technology available, reliability and/or the high cost and complexity of the electrical systems.

An alternative approach includes interrupting the explosive train so that, even if the primary explosive detonator is initiated, at least a portion of the explosive train is not "in line" with the rest, so that the explosive at the end of the explosive train is left undetonated. These systems generally can be classified as either blocking or misaligned. In a blocking system, a barrier or other blockage is positioned so as to interrupt the explosive train. In practice, while the barrier may be exposed to the detonator or other portion of the explosive train, the barrier prevents the explosive train from continuing therepast.

In a misaligned system, at least one portion of the explosive train is shifted so as to not be aligned with the rest of the explosive train. With the system misaligned, the progress of the explosive train is limited by the misaligned location, thereby ending the explosive train extending between the detonator and the explosive. However, with the misaligned portion shifted back into aligned with the remainder, the explosive train can be initiated and maintained to detonate the explosive.

One method of accomplishing the interruption of the explosive train, whether misaligned or blocked, is for an operator to physically remove the barrier or realign the explosive train prior to use. This allows for a safe system up to the point of being physically manipulated. However, once realigned or unblocked, the explosive train is intact. As such, physically interacting with the arming device requires access to the arming device and may result in further handling the armed device prior to actual use.

An alternative method is utilized in ballistic applications in which the interrupted system automatically shifts to an uninterrupted state (i.e., unblocked or aligned) upon the presence of specific external forces or environmental conditions. For a given application, specific environmental or external factors associated with a desired arming condition are determined. For example, a specific impact force applied to the arming device, velocity of the arming device or angular rotation of the arming device can be utilized. Additionally, environmental factors, such as pressure or temperature, can be utilized to transition an arming device to an armed state. However, care must be taken in the selection of the external forces and environmental conditions utilized to arm the arming device as once the external force or environmental condition is encountered the arming device will be armed whether intended or not.

SUMMARY

A device for initiating an explosive train is provided which can be armed just prior to initiation. The device includes an electronic switch for receiving and transmitting signals. An orientation mechanism connected to the switch operates to transition the device from an out-of-line orientation, where a detonation path of a detonator connected to the switch does not extend to the explosive train, to an in-line orientation, where the detonation path extends from the detonator to the explosive train.

In another embodiment, a detonation device is provided which can be remotely armed. In this regard, an explosive train associated with the detonation device can be armed just prior to detonation of a detonator of the detonation device. The detonation device further includes a barrier member positioned between the detonator and the explosive train to inhibit detonation of the explosive train by detonation of the detonator. A biasing member engaged against the barrier member is counteracted by a blocking mechanism engaged by the barrier member. A frangible member of the blocking mechanism is configured to break upon receiving a signal so that the force applied by the biasing member urges the barrier member out from between the detonation device and the explosive train.

Additionally, a method of detonating an explosive train is provided that allows an arming device to be armed just prior to detonation of the explosive train. The method includes transmitting a signal to reposition an arming device to provide a direct path between a detonator and an explosive train. Once the arming device is repositioned the detonator is detonated, along with the explosive train.

DETAILED DESCRIPTION

Figure 1:
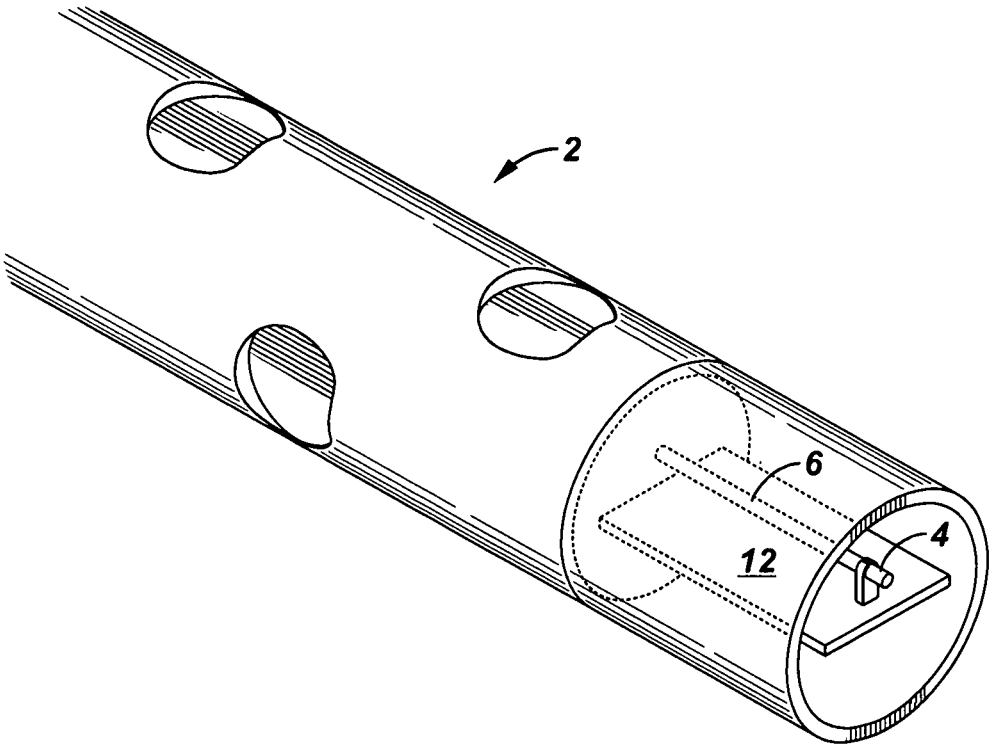
FIG. 1 is a perspective view of a perforating gun having an explosive connected to a detonating device.

In FIG. 1, a system 2 is shown having a detonation device 4 connected to an explosive train 6. The explosive train 6, such as a detonation cord, extends from the detonation device 4 toward an explosive or otherwise ignitable material. The detonation device 4, as shown, is configured to be shifted from an out-of-line orientation 8, such that initiation of the detonation device 4 does not result in ignition of the explosive train 6, and an in-line orientation 10 that allows for ignition of the explosive train 6 upon initiation of the detonation device 4. The detonation device 4 includes an electronic switch 12 for receiving a signal from a remote location, which allows for reorientation of the detonation device 4 without physical interaction by an operator and just prior to initiation of the detonation device 4. As such, the detonation device 4 can remain in an out-of-line orientation 8 until the detonation device 4 is in a predetermined position and the explosive is ready to be ignited.

Figure 2:
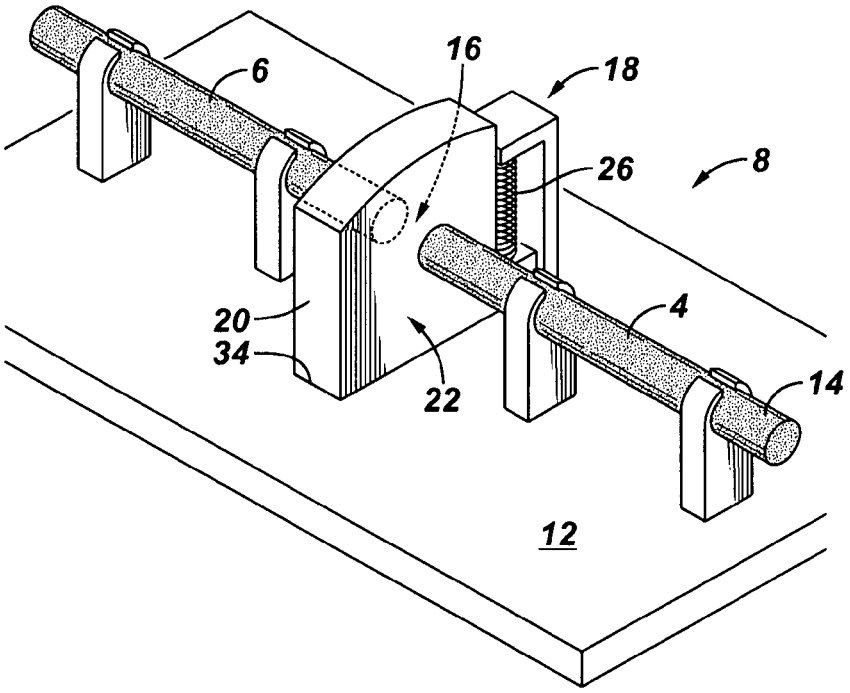
FIG. 2 is a top perspective view of the detonating device of FIG. 1 showing a barrier positioned to provide an out-of-line orientation of the detonating device.

As shown in FIG. 2, the detonation device 4 includes a detonator 14 connected to the switch 12. The detonator 14 contains a primary explosive or otherwise ignitable material. The detonator 14 can be initiated by known methods, such as an electrical current. As shown in FIG. 2, the detonator 14 can be connected to the switch 12, such as by a wire, so that upon receipt of a signal by the switch 12 the switch 12 can relay an electrical current to sufficient to initiate the detonator 14.

The detonator 14 can include known explosive material, including primary explosives and secondary explosives. Primary explosives include, but are not limited to lead azide, lead styphnate, mercury fulminate and combinations thereof. Secondary explosives include, but are not limited to, TNT, PETN, RDX, HMX, HNS, NONA and combinations thereof. Initiation of the detonator 14 results in the dissipation of energy along a detonation path 16 defined thereby.

Figure 3:
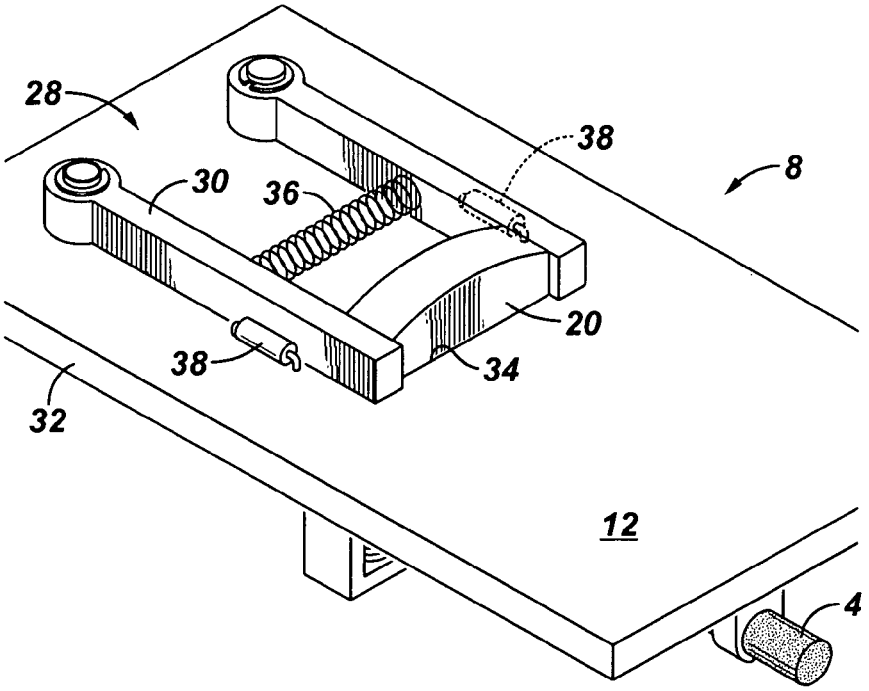
FIG. 3 is a bottom perspective view of the detonating device of FIG. 1.
Figure 4:
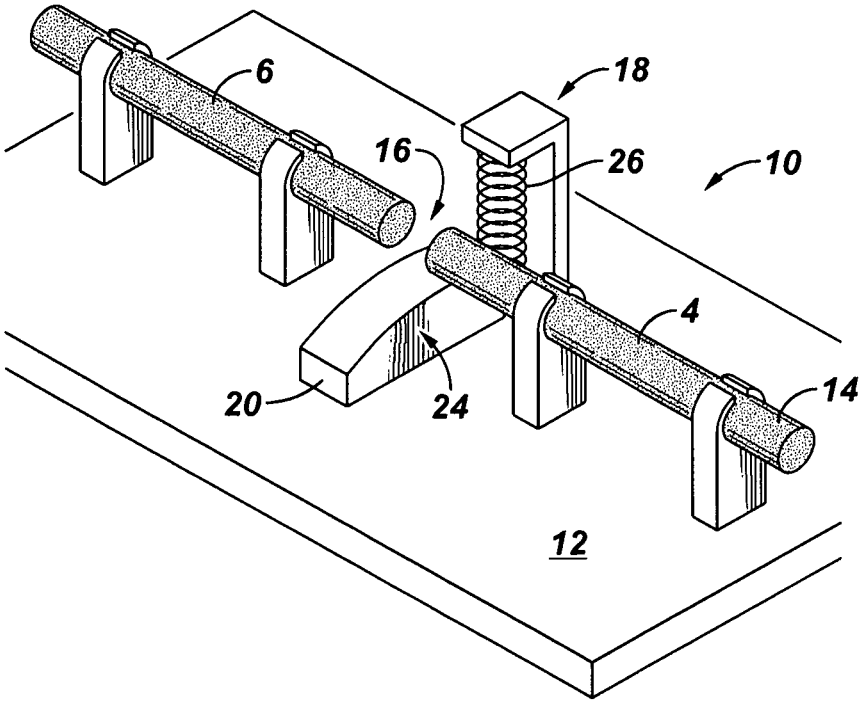
FIG. 4 is a top perspective view of the detonating device of FIG. 1 showing the barrier shifted to provide an in-line orientation of the detonating device.
Figure 5:
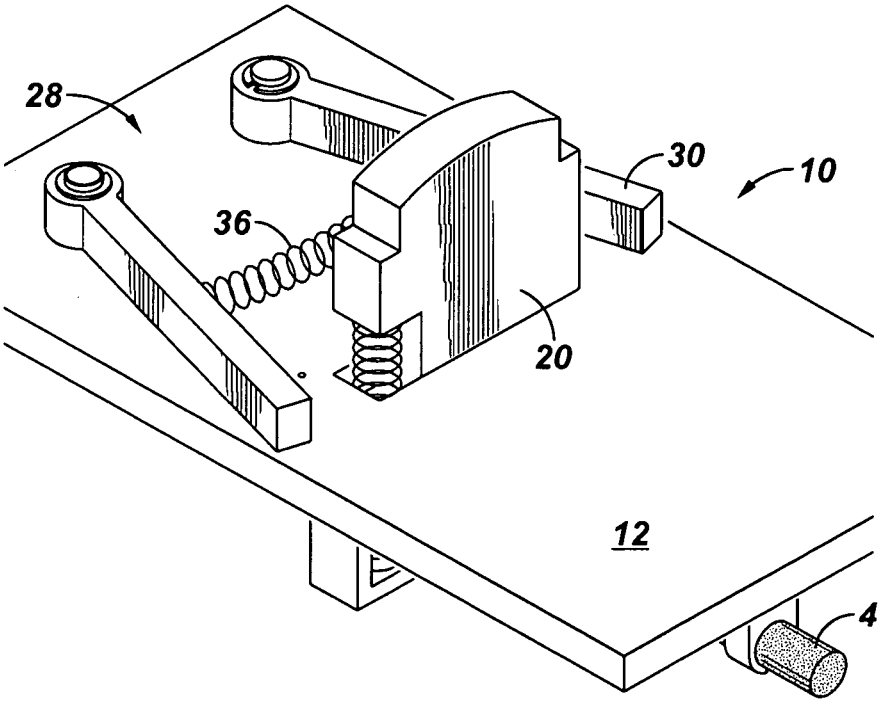
FIG. 5 is a bottom perspective view of the detonating device of FIG. 1 showing the barrier shifted to provide an in-line orientation of the detonating device.

The detonation device includes an orientation mechanism 18 to transition the device from the out-of-line orientation 8, as shown in FIGS. 2 and 3, to an in-line orientation 10, as shown in FIGS. 4 and 5. Initiation of the detonator 14 causes energy to be released. In the out-of-line orientation 8 the energy dissipated along the detonation path 16 does not extend to the explosive train 6. As such, with the detonation device 4 in the out-of-line orientation 10, the explosive train 6 will not ignite as a result of initiation of the detonator 14. In contrast, in the in-line orientation 10, the detonation path 16 provided by the detonator 14 extends to the explosive train 6 so that the explosive train 6 is ignited.

As shown in FIGS. 2-5, the orientation mechanism 18 includes a barrier member 20 shiftable from a blocking position 22 between the detonator 14 and the explosive train 6, corresponding to the out-of-line orientation 8 of the detonation device 4, and an offset position 24 out from between the detonator 14 and the explosive train 6 corresponding to the in-line orientation 10 of the detonation device 4.

As shown in FIGS. 2-4, the barrier member 20 is a formed metal member, however it is contemplated that the barrier member can be formed of ceramic, plastic, carbon fiber or other suitable material. Alternatively, the barrier member 20 includes a plastic section facing the detonator 14 so that, upon initiation with the barrier member 20 in place, the plastic section is first impacted. The plastic section absorbs the impact and reduces the force transmitted through the metal member. The reduced force transmission limits or eliminates the production of shrapnel from a back side of the barrier member 20 facing the explosive train 6 and the possibility of ignition of the explosive train 6 by the shrapnel.

The orientation mechanism 18, as shown in FIGS. 2-5; further includes a biasing member 26, such as a spring, for urging the barrier member 20 toward the offset position 24. To resist the urging provided by the biasing member 26, the orientation mechanism 18 includes a blocking mechanism 28 configured to be engaged by the barrier member 20 and resist shifting of the barrier member 20 from the blocking position 22 to the offset position 24. As shown in FIGS. 3 and 5, the blocking mechanism 28 includes a blocking member 30 pivotably connected to a structural member 32, such as the switch. As shown in FIGS. 2-5, the barrier member 20 extends through an opening 34 of the structural member 32. However, it is contemplated that no structural member is required.

The blocking member 30 of the blocking mechanism 28 can be shifted away from the barrier member 20 by known methods, including the use of mechanical power, such as a motor, and hydraulic pressure, such a via a control system including hydraulic lines, fluid reservoir, or a solenoid valve. Alternatively, such as with a motor, the barrier member 20 could be shifted directly the motor, such as with a lead screw.

Alternatively, as shown in FIGS. 2-5, the blocking mechanism 28 includes a biasing mechanism 36, such as a spring, engaged against the blocking member 30 and configured to urge the blocking member 30 away from the barrier member 20 so that the barrier member 20 can shift to the offset position 24.

A frangible member 38 of the blocking mechanism 28 can be positioned in engagement with the blocking member 30 to prevent the blocking member 30 from moving out of engagement with the barrier member 20. As shown in FIGS. 2-5, the frangible member 38 is secured to and extends from the structural member 32. The frangible member 38 is further connected to the switch 12 to receive a signal therefrom. Upon receipt of the signal, the structural integrity of the frangible member 38 is compromised such that the blocking member 30 can shift therepast and thereby allow the barrier member 20 to shift to the offset position 24.

As shown in FIGS. 2-5, the frangible member 38 is a resistor. The resistor is selected so that, upon receipt of the electrical signal from the switch 12, the resistor breaks. The biasing force applied to the blocking member 30 by the biasing member 36 is sufficient to overcome the resistance provided by the broken resistor. As a result, the biasing member 36 shifts the blocking member 30 out of engagement with the barrier member 20, thereby allowing the barrier member 20 to shift to the offset position 24 and resulting in the detonation device 4 being in the in-line orientation 10.

Figure 6:
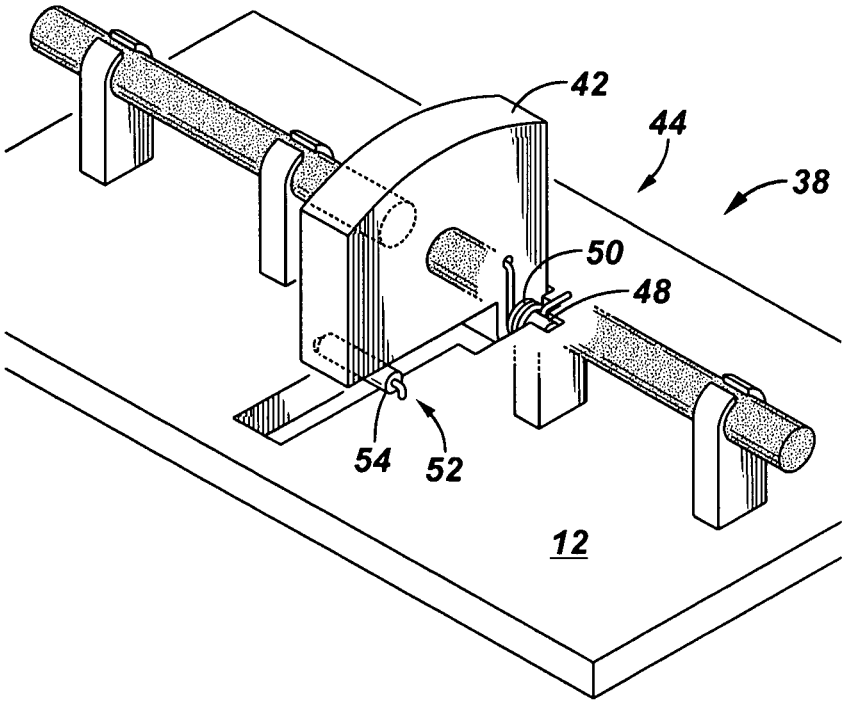
FIG. 6 is a perspective view of another embodiment of the detonating device of FIG. 1 in an out-of-line orientation.
Figure 7:
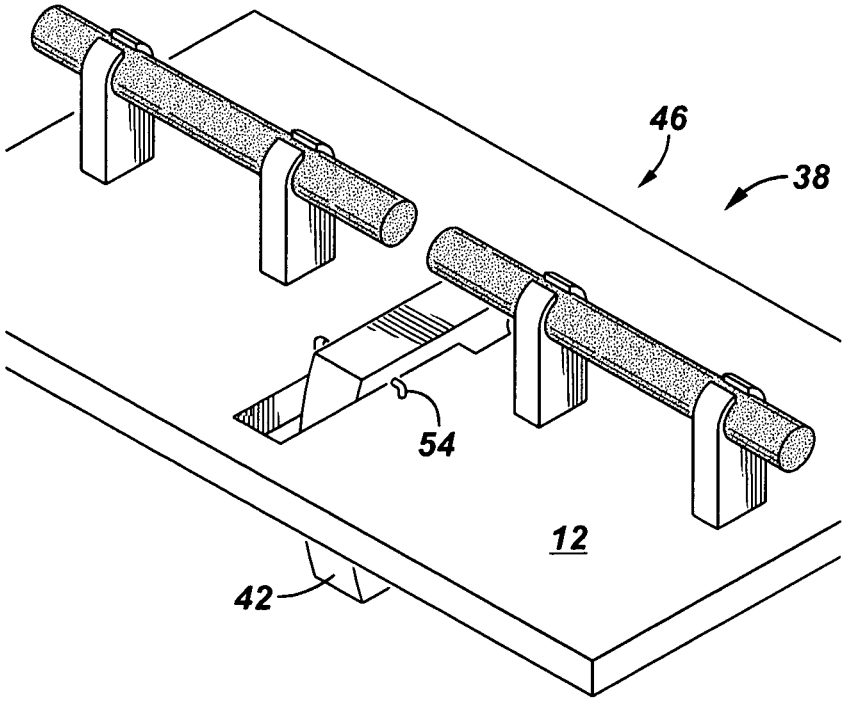
FIG. 7 is a perspective view of the detonating device of FIG. 6 showing a barrier rotated to provide an in-line orientation of the detonating device.

As shown in FIGS. 6-9, alternative detonation devices 38 and 40 are depicted. In FIGS. 6 and 7, the barrier member 42 rotates from an out-of-line orientation 44, as shown in FIG. 6, to an in-line orientation 46, as show in FIG. 7. The barrier member 42 is connected to a pivot member 48, such as a pin, extending therethrough which allows the barrier member 42 to pivot therearound from the out-of-line orientation 44 to the in-line orientation 46. The barrier member 42 is biased toward the in-line orientation 44 by a biasing member 50, such as a spring. Rotation of the barrier member 42 is impeded by a blocking mechanism 52. As shown in FIGS. 6 and 7, the blocking mechanism 52 is a resistor 54. It is contemplated that, as an electric signal from the switch 12 flows through the resistor 54, the resistor 54 will break, melt or otherwise move or cause a member to move so that the barrier member 42 can be shifted toward the in-line orientation 44 by the spring 50.

Figure 8:
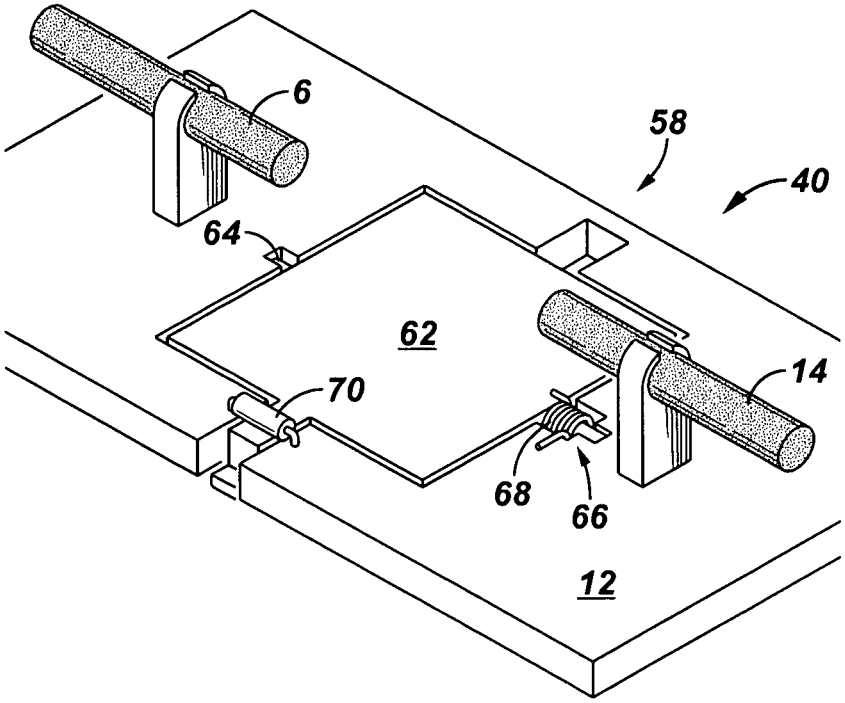
FIG. 8 is a perspective view of another embodiment of the detonating device of FIG. 1 in an out-of-line orientation with the detonator misaligned with the explosive train.
Figure 9:
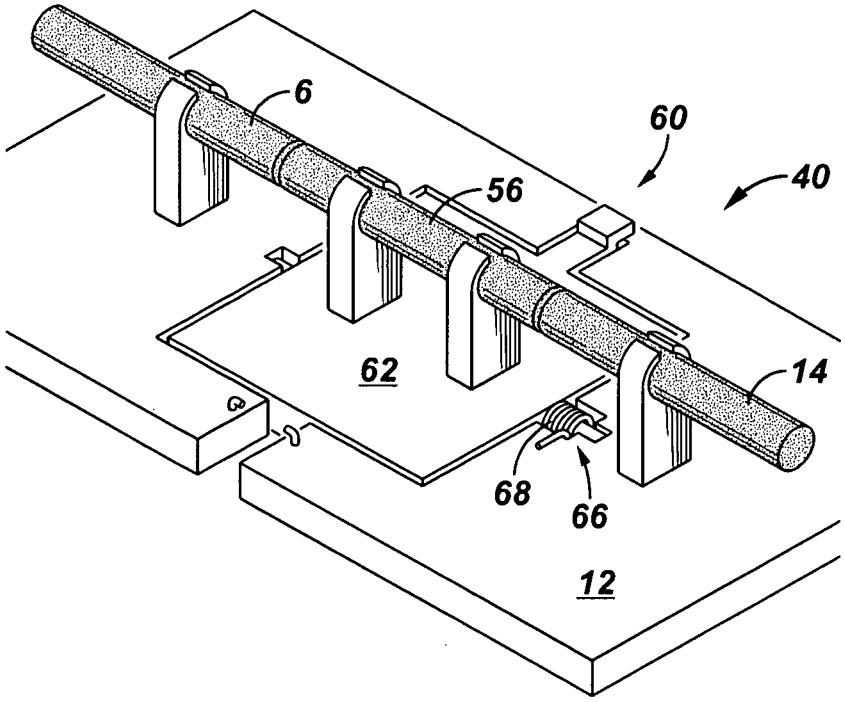
FIG. 9 is a perspective view of the detonating device of FIG. 8 in an in-line orientation with the detonator aligned with the explosive train.

As shown in FIGS. 8 and 9, a detonation device 40 can include a portion 56 of the detonator 14 or the explosive train 6 which can rotate from an out-of-line orientation 58, as shown in FIG. 8, and an in-line orientation 60, as shown in FIG. 9. Similar to detonation device 38 shown in FIGS. 6 and 7, the detonation device 40 includes a pivotable portion 62 including a pivot member 64, such as a pin. The pivotable portion 62 includes either a portion of the detonator 14 or explosive train 6. The pivotable portion 62 is biased toward the in-line orientation 60 by a biasing mechanism 66, such as a spring 68. Rotation of a pivotable portion 62 is impeded by a blocking mechanism 70. As shown in FIGS. 8 and 9, the blocking mechanism 70 is a resistor. It is contemplated that, as an electric signal from the switch 12 flows through the resistor, the resistor will break, melt or otherwise move or cause a member to move so that the pivotable portion can be shifted toward the in-line orientation 60 by the spring 68.

As shown in FIG. 9, with the detonation device 40 in the in-line orientation 60, the detonator 14, explosive train 6 and pivotable portion 62 are positioned relative to one another so that upon initiation of the detonator 14 the explosive train 6 is ignited. Conversely, as shown in FIG. 8, the space between the explosive train 6 and the detonator 14 is sufficient to prevent initiation.

Alternatively, the entire detonator 14 can be rotated so that, in the out-of-line orientation 58, the entire detonator 14 is positioned so that it is not in-line with any part of the explosive train 6.

The resistors disclosed herein can include a carbon composition resistor, which is known to fracture when overloaded. Further, the resistor can be configured to optimize its function as a mechanical release device. In particular, the resistor can include a groove, hole or reinforced leads to further buttress its mechanical blocking capability.

In an alternative embodiment, the frangible member can include a meltable portion which, upon the application of heat or electricity, melts so that the structural integrity of the frangible member is compromised. The meltable portion can include a body formed from an electrically conductive plastic which is connected to electrical leads, which may or may not be integrated therewith. Passing electricity through the electrically conductive plastic causes the plastic to melt, and thereby reduces the structural integrity of the plastic. Alternatively, a plastic or otherwise meltable material can be positioned to be engaged by the blocking member. A resistor, or other electrical component, is positioned adjacent the meltable material so that, as electricity flow through the resistor and breaks the resistor, the resulting energy melts the meltable material.

It is contemplated that two barrier members or out-of-line mechanism can be implemented in a detonation device. The mechanisms for creating the out-of-line mechanism can be the same or different from one another.

It is contemplated that the switch is an addressable switch, such as described in U.S. Pat. Nos. 7,347,278 and 7,505,244, incorporated by reference in its entirety herein. In particular, the addressable switch can control the release or positioning of the blocking mechanism by sending an electrical signal to a motor, control system, solenoid valve or other known systems. Further, it is contemplated that the addressable switch can provide feedback on the status of the system as a whole and its integrity.

It is further contemplated that the switch sends a series of signals to the detonating device, such as at least two signals, and the repositioning of the detonating device occurs as a result of the receipt of the two signals within a specified period of time. Alternatively, other known methods and devices for confirming an instruction, such a detonation instruction, can be utilized.

In addition, it is contemplated that an external testing device can be utilized to query and report the status of the system and any safety protocols. Such a device could be utilized to verify the existence and/or integrity of the barrier member and/or blocking mechanism. For example, a current could be run through the blocking member, with the current being utilized to establish the existence, integrity and/or placement of the barrier member.

One use of the disclosed system is to arm a perforating gun remotely, after it is downhole and at a specific depth, regardless and independent of other factors such as pressure, temperature, movement, depth, or the presence of markers providing a signal to the system or a member within the wellbore engaging the system.

While various embodiments have been described herein with respect to a limited number of examples, those skilled in the art, having benefit of this disclosure, will appreciate that other embodiments and variations thereof can be devised which do not depart from the scope disclosed herein. Accordingly, the scope of the claims should not be unnecessarily limited by the present disclosure.

What is claimed is:

1. A device for initiating an explosive, the device comprising:

a switch for receiving and transmitting signals;

a detonator for initiating the explosive train, the detonator connected to the switch for receiving a signal therefrom;

a detonation path along which energy is dissipated upon detonation of the detonator;

an out-of-line orientation such that the detonation path does not extend from the detonator to the explosive train;

an in-line orientation such that the detonation path extends from the detonator to the explosive train; and an orientation mechanism connected to the switch for receiving a signal therefrom and operable to transition from the out-of-line orientation to the in-line orientation, wherein the orientation mechanism includes a frangible member for resisting the biasing member and maintaining the device in the out-of-line orientation.

2. The detonating device of claim 1, wherein the orientation mechanism includes a biasing member for urging the device toward the in-line orientation.

3. The detonating device of claim 1, wherein the frangible member is a resistor connected to the switch breakable upon receipt of signals therefrom.

4. The detonating device of claim 1, wherein the orientation mechanism includes a second frangible member.

5. The detonating device of claim 1, wherein the switch is an addressable switch.

6. The detonating device of claim 1, wherein the orientation mechanism includes a barrier member shiftable between a first position in the detonation path between the detonator and the explosive train to provide the out-of-line orientation and a second position not between the detonator and the explosive to provide the in-line orientation.

7. A detonation device for detonating an explosive train, the device comprising:

a switch for receiving and transmitting signals;

a detonator connected to the switch;

a barrier member positioned between the detonator and the explosive train to inhibit detonation of the explosive train by detonation of the detonator;

a biasing member engaged against the barrier member to urge the barrier member out from between the detonator and the explosive train;

a blocking mechanism engaged by the barrier to resist shifting of the barrier member out from between the detonator and the explosive train; and a frangible member of the blocking mechanism connected to the switch to receive a signal therefrom to break the frangible member such that the biasing member overcomes resistance provided by the blocking mechanism and urges the barrier member out from between the detonator and the explosive train.

8. The device of claim 7, wherein the frangible member is a resistor.

9. The device of claim 8, wherein the resistor is a carbon composition resistor.

10. The device of claim 7, wherein the switch is an addressable switch.

* * * * *